US005393180A

United States Patent [19]

Van Den Aarsen

[11] Patent Number: 5,393,180

[45] Date of Patent: Feb. 28, 1995

[54] CONTAINER LOADING AND EMPTYING DEVICE FOR A REFUSE VEHICLE AND PICK UP MEMBER FOR THE SAME, AND ALSO GUIDES FOR THE PICK UP MEMBER

[75] Inventor: Gerardus F. A. Van Den Aarsen, Benthuizen, Netherlands

[73] Assignee: V.D.A. Konstrukties B.V., Netherlands

[21] Appl. No.: 120,522

[22] Filed: Sep. 14, 1993

[30] Foreign Application Priority Data

Sep. 17, 1992 [NL] Netherlands ..... 9201611

[51] Int. Cl.[6] ..... B65F 3/08

[52] U.S. Cl. ..... 414/409; 414/408; 414/406; 414/648; 414/422; 414/627; 414/737

[58] Field of Search ..... 414/403, 404, 405, 406, 414/407, 408, 409, 410, 419, 420, 421, 422, 423, 424, 425, 546, 555, 539, 540, 541, 542, 737, 592, 648, 649, 627

[56] References Cited

U.S. PATENT DOCUMENTS

| | | | |
|---|---|---|---|
| 1,492,675 | 5/1924 | Clark et al. | 414/648 X |
| 1,723,003 | 8/1929 | Barrett | 414/648 X |
| 1,820,526 | 8/1931 | Caldwell | 414/406 |
| 2,592,324 | 4/1952 | Oliver . | |
| 3,942,663 | 3/1976 | Wentzel | 414/648 X |
| 4,057,156 | 11/1977 | Thompson et al. | 414/408 |

FOREIGN PATENT DOCUMENTS

| | | | |
|---|---|---|---|
| 0464950 | 1/1992 | European Pat. Off. . | |
| 1227370 | 10/1966 | Germany | 414/648 |
| 3424797 | 1/1986 | Germany | 414/408 |
| 9105721 | 5/1991 | WIPO | 414/406 |

*Primary Examiner*—Frank E. Werner
*Attorney, Agent, or Firm*—Larson & Taylor

[57] ABSTRACT

The invention relates to a container loading and emptying device for a refuse vehicle with an endless carrier consisting of two chains (10,11), which runs in a substantially vertical plane along a substantially rectangular path, one or more pick up members (13), which are fitted to a shaft (12) connected to the endless carrier (10,11) and which are rotatable around this shaft (12) and tilting means consisting of rolls (15,16,17,18) mounted to the pick up member (13) and guides (*27a,27b,28,27a',27b',28',30,31*) for the said rolls mounted on the frame (3), with which at the upper angular points and a successive part of the upper part of the path the pick up member (13) rotates over an angle of 180°, wherewith seen in the lowermost vertical position, the pick up member (13) is provided with two rolls (17,18) mounted symmetrically with respect to the vertical central line of the pick up member (13) below the pivot point of the pick up member (13), with guides (*27a,27b,28,27a',27b',28'*) for the said rolls (17,18) mounted at the upper angular points of the path and that the shaft (12) which connects the chains (10,11) to each other and whereto the pick up member (13) is fitted, is a straight shaft.

9 Claims, 6 Drawing Sheets

CONTAINER LOADING AND EMPTYING DEVICE FOR A REFUSE VEHICLE AND PICK UP MEMBER FOR THE SAME, AND ALSO GUIDES FOR THE PICK UP MEMBER

The invention relates to a container loading and emptying device for a refuse vehicle with an endless carrier consisting of two chains, which runs in a substantially vertical plane along a substantially rectangular path, one or more pick up members, which are fitted to a shaft connected to the endless carrier and which are rotatable around this shaft and tilting means consisting of rolls mounted to the pick up member and guides for the said rolls mounted on the frame, with which at the upper angular points and a successive part of the upper part of the path the pick up member rotates over an angle of 180°.

Such a device is known from EP-A-0.464.950, which stands in the name of applicant. With this known device the pick up member for refuse containers is carried along a rectangular path and is rotated over an angle of 180° at the upper angular points of the upper horizontal part of the path. These rotations are realized by a cooperation of rolls mounted to the pick up member and guides attached to the frame.

The pick up member is pivotable around a shaft which is mounted to the endless carrier consisting of two chains. Seen in normal position, the position wherein the container can be coupled, the pick up member has two rolls on a mounting plate above the attachment point of the pick up member at either side of the central line. A leg is provided at the lower side of the mounting plate which at its outer end has a shaft perpendicular thereto, which rests against a chain of the endless carrier along the vertical parts of the path followed by the pick up member. A third roll is attached to the shaft connected to the leg, which lies between the chains along these vertical parts of the path.

The two rolls located above the pivot axis together with two guides located along the upper horizontal part of the path provide for the rotation of the pick up member from a overturned position to a totally inverted position and vice versa.

The lowermost third roll together with a guide extending from the upper part of a vertical part of the path to above the upper horizontal part of the path, provides for the far greater rotation from the normal position to the overturned position and vice versa.

The construction of a leg mounted to a mounting plate, which has a roll attached to its outer end by means of a protruding shaft is a construction for which it is as good as impossible to get it sufficiently rigid.

Because the lowermost third roll is between the two chains and consequently the guide for this roll is also located between the chains, a modification for the shaft whereto the pick up member is mounted had to be provided for. This shaft fixedly connected to the chains has such an U-shape that the said guide can be passed freely.

This U-shaped construction also has the disadvantage of not being sufficiently rigid.

The different parts not being sufficiently rigid results in a not well controllable path for in particular a full container, wherewith the container starts swaying and possibly even ends up with the lower roll next to the guide.

The aim of the invention is to overcome these disadvantages and to provide a container loading and emptying device with which the pick up member follows an at all times controlled movement.

Accordingly it is provided by the invention that, seen in the lowermost vertical position, the pick up member is provided with two rolls mounted symmetrically with respect to the vertical central line of the pick up member below the pivot point of the pick up member, with guides for the said rolls mounted at the upper angular points of the path and that the shaft which connects the chains to each other and whereto the pick up member is fitted, is a straight shaft.

Along with this the four rolls which in combination with the corresponding guides provide for the tilting of the pick up member are mounted to one mounting plate, which is pivotable around a straight shaft. This provides for sufficient rigidity to keep the pick up member under all circumstances in the right path.

Another disadvantage of the known device is that the pick up members with the containers may sway outwardly with the lower part along the vertical parts of the path, which may occur for example with stopping and starting anew of the container loading and emptying device.

Further the invention provides that along the vertical sides of the path followed by the pick up member U-shaped guides are mounted for the lowermost roll located at the outer side. By means hereof the eventual swaying of the pick up member becomes impossible.

By also providing that the U-shaped profiles have an extension which extend to above the upper horizontal part of the path and consist of guides which are located at only the outer sides of the outermost rolls, it is accomplished that in downward direction the lower and outermost roll ends up easily again in the U-shaped profile.

Such a guidance also means an extra retaining means for the lowermost pair of rolls which goes along the two respective guides with the pick up member going down, but are not pulled firmly there against, as is the case with the upward directed movement.

From the lower part of the vertical parts of the path the U-shaped profile passes into an angle section, which continues along the lowermost horizontal part of the path. Along this part of the path both the lowermost rolls rest on this profile.

According to a preferred embodiment it is provided that the pick up members are slidable along their attachment shaft and that a guide is provided for along the lowermost horizontal path, which displaces the pick up member in the direction of the endless carrier. Herewith it is preferably provided that the pick up cam mounted to the pick up member abuts the lowermost guide.

Further it is provided that the pick up member is again moved away from the chains at the beginning of the vertical parts of the path, which is realized with two rolls mounted at either side of the shaft on the backside of the mounting plate of the pick up member, which cooperate with corresponding cams mounted to the frame.

With these measures it is achieved that after emptying the container the pick up member is moved backwards at the beginning of the lowermost horizontal path and is moved back again in the lower part of the vertical path, just before the picking up of a container. With this it is prevented that a container, not placed in exactly the right place at the loading device, is pushed aside by the pick up member and subsequently is missed with the picking up thereof.

A further elaboration of the invention provides that the pairs of sprocket wheels over which the chains run are supported at both sides. With the known device these are supported on one side, as a result of which the outermost chain is tensioned less than the innermost chain and the pick up members with the containers come to hang oblique and the rolls may end possibly next to the guides.

Also part of the invention is that seen in normal position holding members for a container are mounted at the lower side of the pick up member. These holding members preferably consists of holding members working with reduced pressure.

The reduced pressure is obtained with a vacuum pump which is mounted between the chains on the attachment shaft. Preferably this is an electric pump. The voltage needed for this pump is taken from a voltage rail, placed at a distance from the chains and running parallel thereto.

Then the container is held at the upper side with a holding device known per se, which cooperate with the pick up cam and with the said holding members at the lower side. In this manner a container can be held firmly and guiding means for the container itself, as with the known device mounted along the upper side of the refuse receiving member, may be left out.

Also it is provided that one of the lowermost pairs of sprocket wheels is mounted in a bracket pivotable with respect to the frame, with pneumatic or hydraulic chain tensioners mounted between the frame and the pivotable bracket.

The chains will stretch during use, as a result of which the pair of sprocket wheels with the chain tensioners will move downward. With this the path taken by the pick up member also will be located slightly lower. Although the movements are small, it still is desirable that the guides for the pick up member and the voltage rail move along downward. With a loading device of the size used for the collection of household refuse a tension of several millimeters to one centimeter has to be reckoned with. Hereby a more or less usual stretch percentage of 0,1% of the total length of the chain within the normal lifetime of that chain is assumed.

The invention provides that one or more of the guides and the voltage rail along the lower side of the path are mounted on a bracket, which is attached to the protruding parts of the shafts of the lowermost pair of sprocket wheels. Hereby the parts of the guides mounted on the bracket connect to the parts of the guides mounted on the frame, but are not rigidly attached thereto. At these places the voltage rail is provided with a sleeve coupling.

The invention is elucidated in the following on hand of the drawing, in which.

Figure 1:
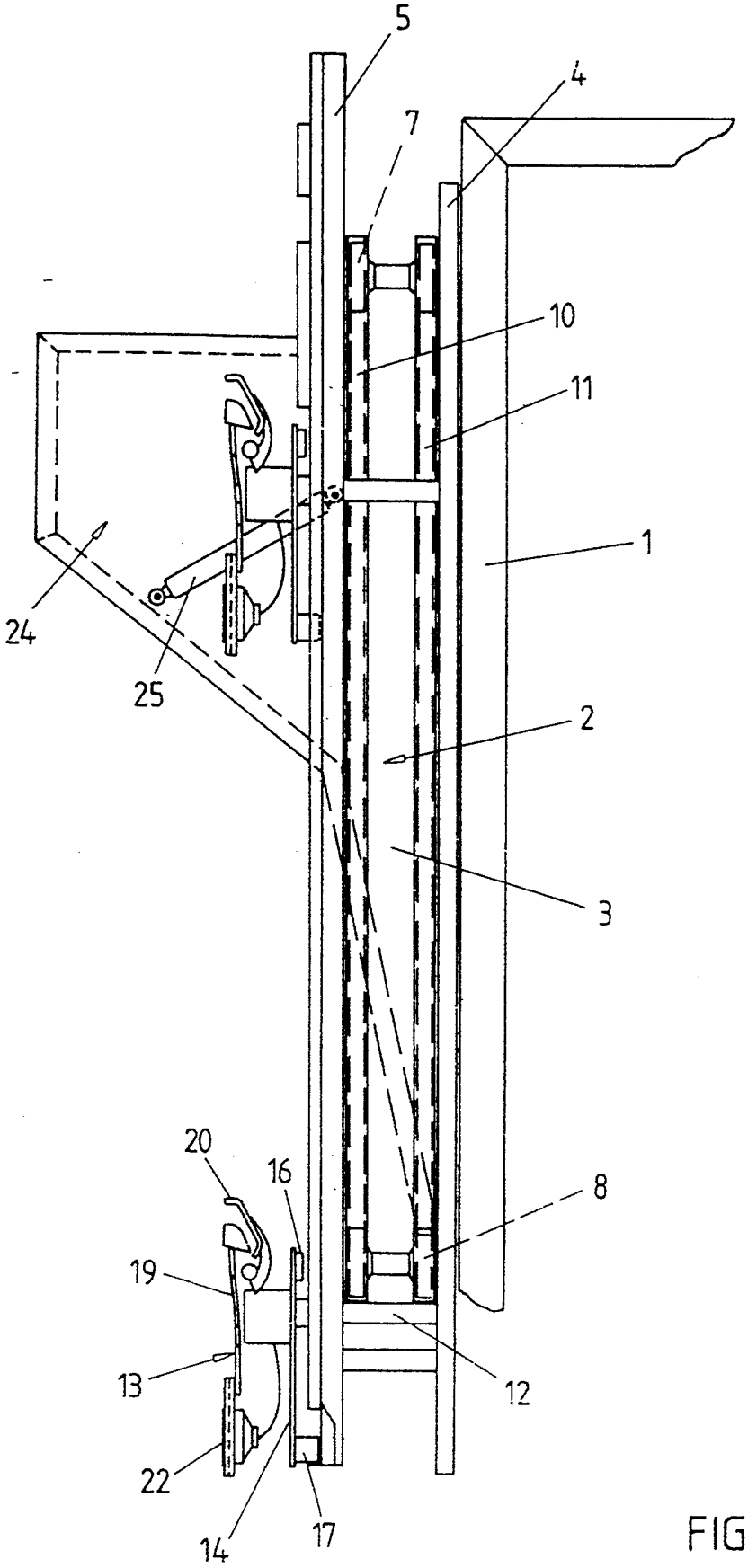
FIG. 1 shows schematically a side view of the container loading and emptying device.

In FIG. 1 the frame of the refuse vehicle is indicated with 1, which in the drawing extends further to the right. There against a container loading and emptying device 2 is mounted, which consists of a mainframe 3 and secondary frames 4 and 5.

The mainframe 3 is a rectangular frame with on each of the angular points a pair of sprocket wheels 6,7,8 and 9, over which parallel to each other chains 10 and 11 run. The pairs of sprocket wheels are supported on both sides. This has the advantage with respect to the known construction with a protruding shaft supported at one side, that no bending occurs and consequently the chains do not have different tensions. A further advantage of this construction is that the total depth of the construction becomes less and with that the weight is moved more to the inside.

The attachment shafts 12 are fixedly connected to the chains 10 and 11, with the pick up members 13 pivotally mounted thereto. The pick up members 13 consist of a mounting plate 14 with mounted thereto the rolls 15,16,17 and 18, necessary for the tilting of the Pick up member and whereto at some distance also the proper means (20,36,21,22,50) are mounted for picking up and holding a container.

Figure 2:
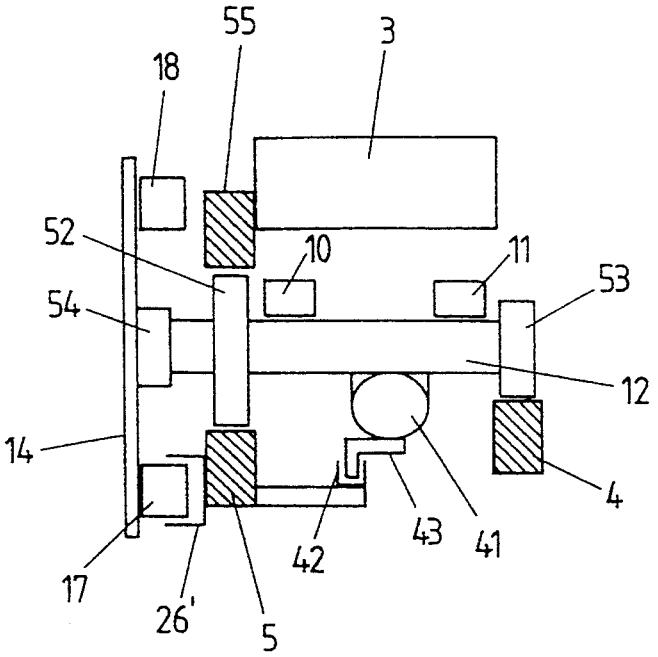
FIG. 2 shows schematically a section of a vertical part of the path.

The attachment shafts 12 are provided further with supporting rolls 52,53 which are mounted on either side of the set of chains 10,11 (vide FIG. 2). The supporting roll 52 at the side of the pick up member runs between two guides 5,55 along the whole path and the other supporting roll 53 has only an outer guide along the whole path, in this case secondary frame 4. The supporting roll 52 runs between the guides with some play, as a result of which it never contacts with two guides at the same time.

The system with the supporting rolls 52,53 and the respective guides serves to stabilize the course of the pick up member with container, and is of particular importance in the uppermost part of the path.

In front of the mounting plate 14 the actual pick up cam 19 is mounted with which the containers are picked up. After a container has been picked up, it is secured with a clamping member 20 between the pick up cam 19 and the clamping member 20. At the lower side of the pick up member 13 further holding means are provided, which consist of two caps 21,22 made out of flexible synthetic material. These caps come to abut the container whereafter with a vacuum pump a pressure lower than atmospheric is applied in these caps, and the container is sucked firmly against a cross plate 50 mounted at the lower side of the pick up cam 19.

This cross plate 50 is bent over at the outer ends, in such a way that the cross plate follows a part of the form of contour of the container. This means that with the vacuum pump only a sufficient reduced pressure have to be generated in the holding means 21,22 in order to hold the container against the cross plate 50, and that transverse forces, which arise while going along the path, are taken by the bent over parts 51 of the cross plate 50.

The secondary frames 4 and 5, which are connected to each other with cross connections 23, serve among others to provide a support for the guides for the rolls 15–18 passing the chains of the endless carrier on the outside. The secondary frame 4 is connected to the mainframe 3 round the back of chain 11, whereby also a direct connection to the frame 1 of the refuse vehicle may be provided.

With the secondary frames also a support is obtained for the refuse receiving member 24. This member protrudes through frame 3 and connects to the refuse receiving space of the refuse vehicle. The member is connected to the support formed by the secondary frames with fastenings 25.

Figure 3:
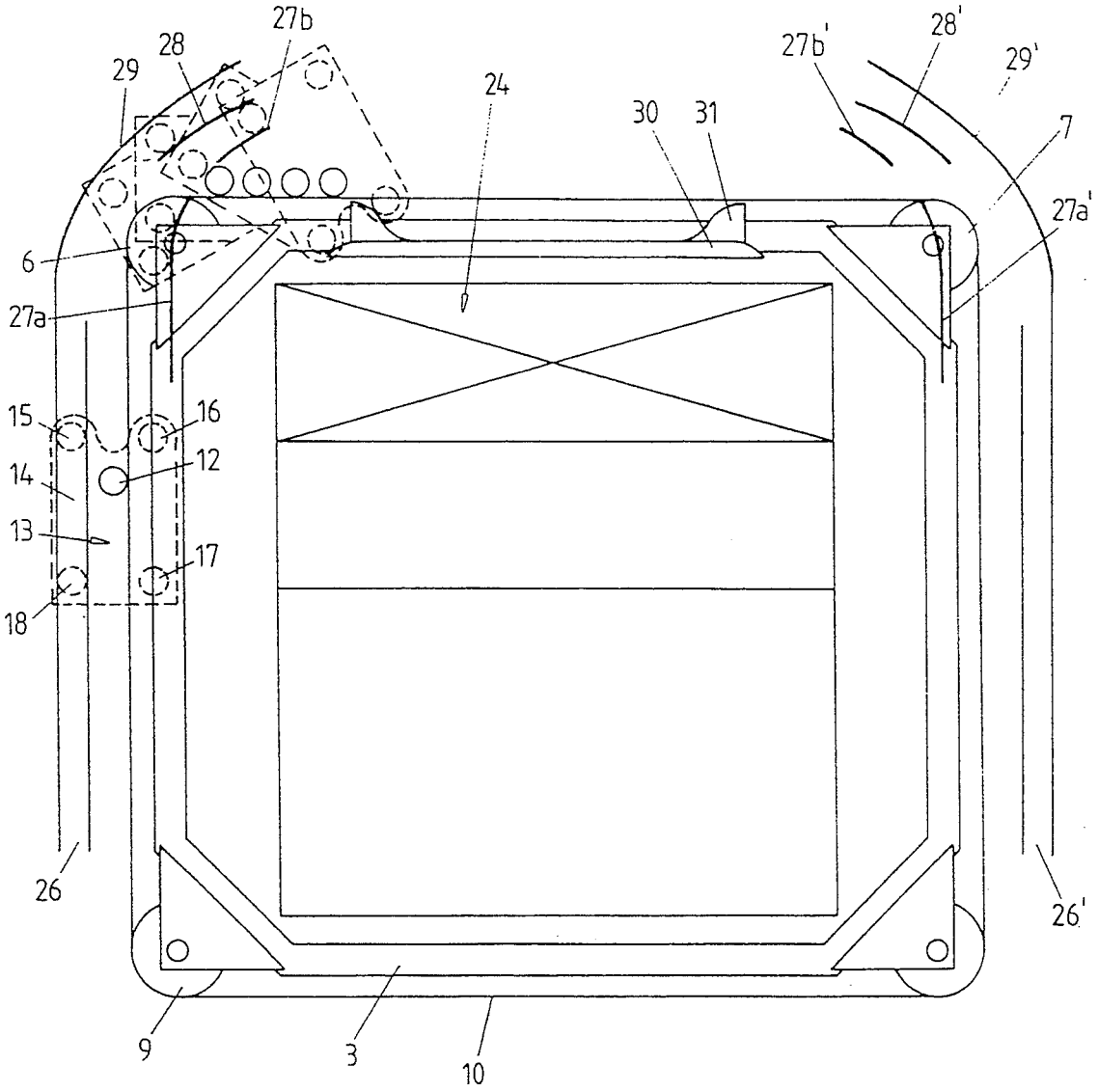
FIG. 3 shows schematically the movement of a pick up member.

FIG. 3 shows schematically the path followed by the pick up members, at least part of it. The mainframe 3 with the pairs of sprocket wheels 6–9 at the angular points are indicated and schematically the pick up members, of which in fact only the mounting plate with the rolls 15–18 is shown.

Along the vertical parts of the path U-shaped profiles 26,26' are mounted, in which the lowermost, outermost roll 17,18 runs. These guides prevent the pick up members with the containers from starting to sway for whatever reason.

At the upper angular points guides **27*a*,27*b* and 28 are mounted, which in cooperation with the rolls 17,18** provide for the tilting from a normal position to an overturned position and vice versa.

In the given example the roll 17 abuts the guide **27*a* even before the attachment shaft 12 starts with the upper horizontal part of the path. As soon as the shaft 12 reaches the horizontal part of the path the tilting starts, brought about by the cooperation of roll 17 with guide 27*a***.

The guide for this roll has to be made up of two parts **27*a* and 27*b*, because the guide extends from within the path of the chains 10,11** to outside of it and consequently crosses the path of the protruding attachment shaft.

Before the roll 17 reaches the end of the guide **27*a*, the roll 18 already abuts the guide 28. As soon as this roll 18 comes up to the end of the guide 28, the roll 17 abuts again the guide 27*b***.

When the roll 17 comes to the end of the guide **27*b*, the rest of the tilting is already taken over by the rolls 15,16, lying above the pivot point of the pick up member, in cooperation with the guides 30,31. The guides 30,31 bring the pick up member in a totally inverted position and from there at the other end the tilting is continued further and taken over by the guides 27*a*',27*b*' and 28** mounted at this side.

In the middle of the guides 30,31 some small bumps may be provided. When passing these bumps the pick up member with container makes some fast movements to the left and the right and also those refuse remainders fall out of the container that otherwise would have stuck to one of the walls.

The U-shaped profiles 26,26' have extensions 29,29'. These are meant to give an extra guidance specially when a pick up member goes from above downwards. With this movement the rolls 17,18 are no longer pulled tightly against the guides as with the upward movement and may be pushed to the outside with possible changes in the speed of motion and/or direction of speed.

Figure 4:
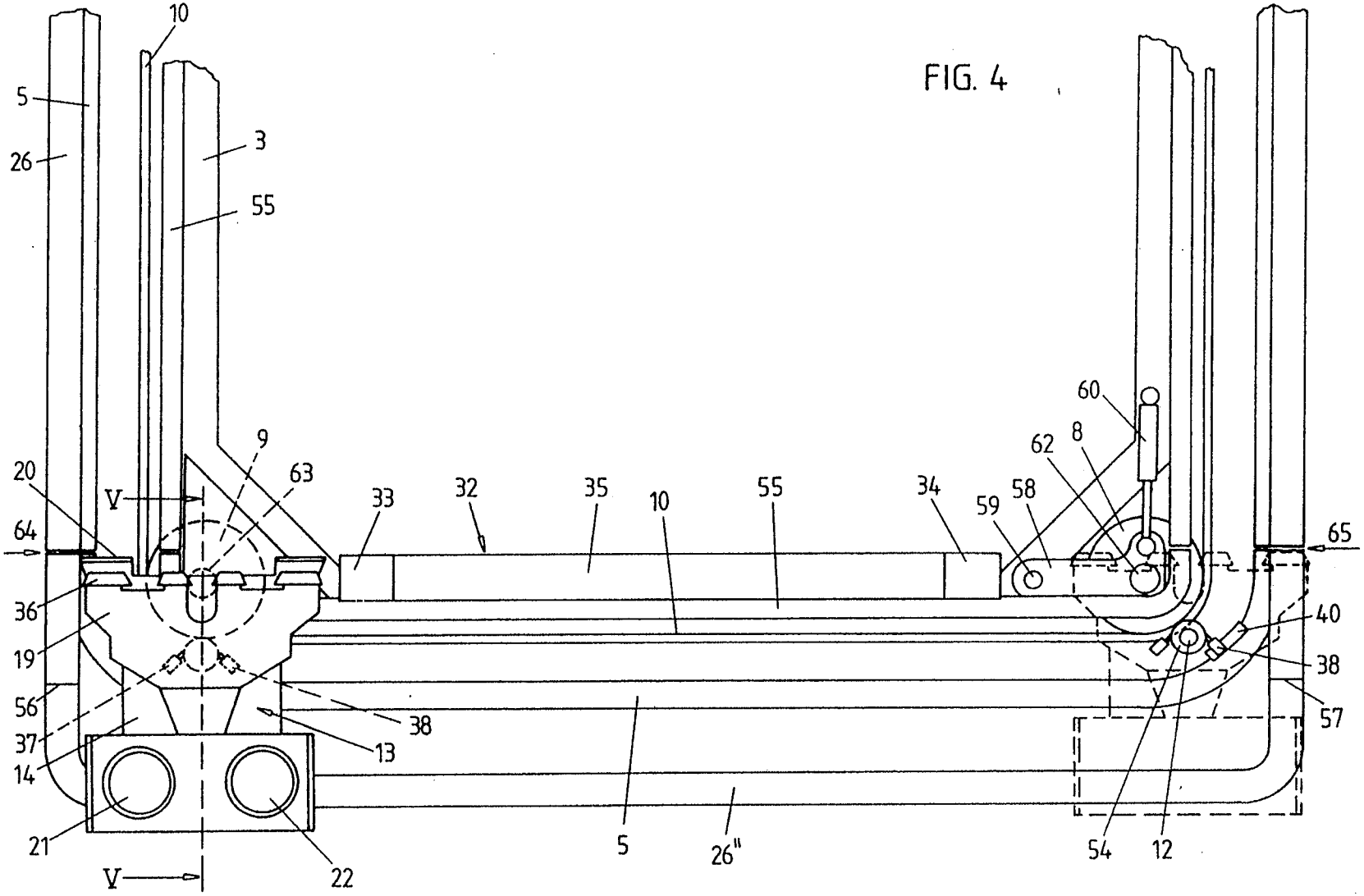
FIG. 4 shows schematically the guides for the pick up member in the lowermost part of the path.

FIG. 4 shows the course of the various guides along the lowermost part of the path as well as the construction with the chain tensioners.

Along the lowermost part of the frame a guide 32 is mounted for the pick up members 13, which cooperates with the pick up cam 19 of the pick up member 13. The pick up members 13 may slide to and fro on the attachment shaft 12, to and fro the chains 10,11. At both ends the guide has parts 33,34 extending obliquely forward, with which the pick up member is guided backward in the subsequent part 35 of the guide 32.

The pick up cam 19 is provided with parts 36 of synthetic material which come in direct contact with the guide 32.

The pick up member 13 fits around the attachment shaft 12 with a sleeve 54. Rolls 37,38 directed obliquely downward are attached hereto, which are intended to cooperate with guides 39,40, mounted at the transition of the lowermost horizontal part of the path with the vertical parts of the path. After a roll 37,38 has passed a respective guide 39,40, the pick up member is located on exactly the right position in the plane of the subsequent part of the path.

After an emptied container is released, the pick up member is moved backward and at the beginning of a vertical part of the path is moved forward again just before the pick up cam reaches the pick up edge of the container. These measures see to it that a container not precisely placed, is not pushed aside by the pick up member before it reaches the pick up position.

Further the guides for the supporting rolls 52,53 and the rolls 17,18 are shown in this figure.

The U-shaped profiles 26,26' for the rolls 17,18 have an extension 26'' along the whole of the lowermost part of the path. The U-shaped profile changes into an angle section at the lines 56,57, because in the lowermost part both rolls 17,18 must be able to come to rest on the bar.

The pair of sprocket wheels 8 is attached to the frame 3 through an arm 58, which has a pivot point 59 on frame 3. A hydraulic or pneumatic pair of chain tensioners 60, one at each side, is connected with the arm 58 and the frame 3. A right chain tension is guaranteed by keeping these chain tensioners on a pressure determined beforehand.

The pair of sprocket wheels 8 and therewith also the path of the pick up member 13 come to be situated lower with stretch of the chains. In order to see to it that the guides for the rolls 17,18 and the supporting rolls 52,53 go through an equal movement downward, a carrying member 61 for these guides is provided, which follows the movement of the pair of sprocket wheels 8.

Figure 5:
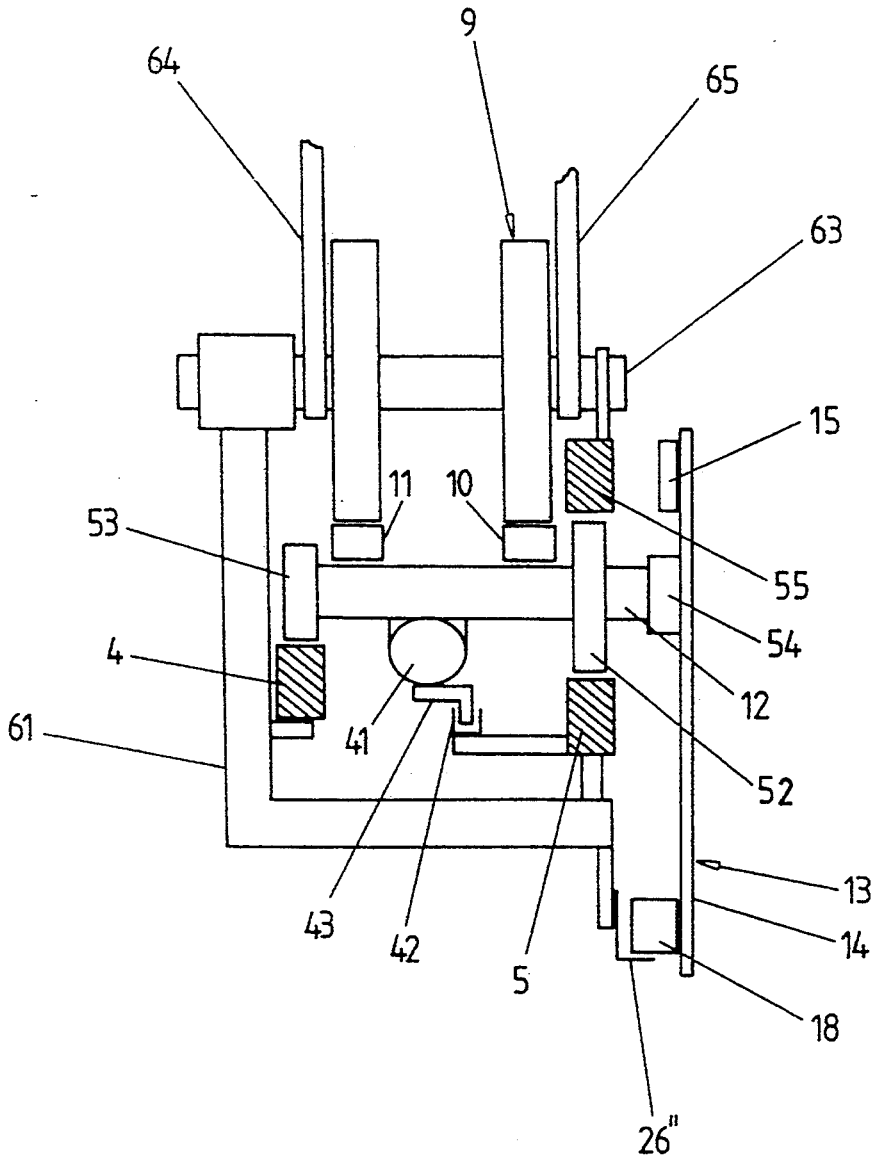
FIG. 5 shows a section along line V—V in FIG. 4.

FIG. 5 shows how the carrying member is attached to the parts of the shafts 62,63 (vide FIG. 5) protruding in the direction of the refuse vehicle not shown. The carrying member extends from this side to the other side of the pairs of sprocket wheels. The pair of sprocket wheels 9 is mounted to frame 3 with mounting plates 64,65. Attached to the carrying member are the guide 4 for support roll 53, guide 5 for support roll 52, the guide 26'' for rolls 17,18 and a voltage rail 42. At the other side the guide 55 for the support roll 52 is attached directly to the shafts 62,63.

At the location of the arrows 64,65 the guides are interrupted to allow movement of the guides. These interruptions do not affect the guidance, because the movement as a result of the stretch of the chains is small, usually in the order of about 4–10 millimeter.

The voltage rail 42, also attached to the carrying member, is not interrupted, but provided with a sleeve, with which the change in length can be taken.

Figure 6:
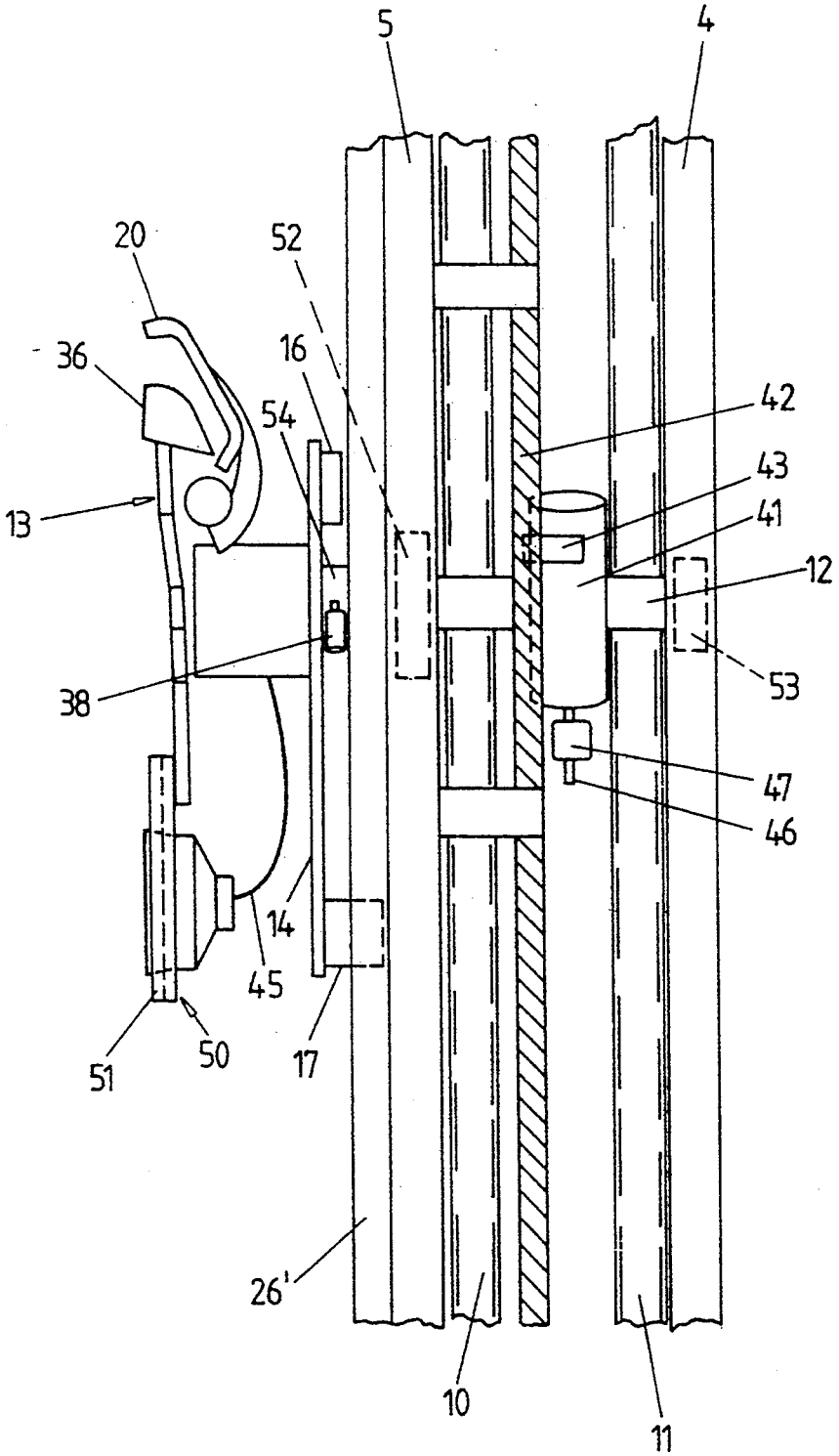
FIG. 6 shows a side view of a part of the container loading and emptying device.

Finally in FIG. 6 a detail of the container loading and emptying device is shown. At the underside of the pick up member 13 holding members 21,22 are mounted working with reduced pressure. The reduced pressure is provided by a vacuum pump 41 which is mounted on the attachment shaft 12.

Preferably this is an electric pump which takes its necessary voltage from a voltage rail 42 with the help of a slide contact 43. From the pump a duct leads centrally trough the shaft 12 to the pick up member 13, where the duct splits into two ducts, one duct 44,45 for every holding member 21,22.

The construction with the duct leading centrally through the shaft is chosen in order to avoid problems with the differences in rotation between the shaft 12 and pick up member 13 with the vacuum pump 41 which arise when going along the path. Although both the pick up member 13 and the vacuum pump 41 rotate over 360° when going along the whole path, a maximum difference of 180° arises between both members, because at each angular point the pump rotates over 90° and the pick up member only rotates at the upper angular points and than over an angle of 180°.

Through a duct 46 the air drained off leaves the vacuum pump 41. In this duct a sound absorber 47 is mounted.

With a switching device not further indicated the pump 41 is switched on and off, which can be done with a similar known switching device such as is used for the clamping system with which a container is clamped between the pick up cam 19 and the clamping member 20.

With such a switching device also the space within the holding member can be connected with the open air before the container is released.

I claim:

1. A container loading and emptying device for a refuse vehicle having an endless carrier, said device comprising:

a substantially rectangular frame;

two chains running in a substantially rectangular path around said frame;

a shaft connected to the two chains;

a pick up member pivotally mounted on one end of the shaft;

rolls mounted on the pick up member at positions above and below said shaft such that at any given position along a vertical axis of said frame, said rolls including an innermost lower roll and an outermost roll positioned on said pickup member such that they are below the shaft when said pickup member is in a upright position, said outermost roll being positioned at a greater distance from said frame than said innermost roll; and guides located at upper angular points of the frame for cooperating with said rolls to provide a means for tilting said pick up member 180 degrees, said guides comprising innermost and outermost guides, said outermost guide being positioned at a greater distance from said frame than said innermost guide, said innermost guide comprising a first portion for guiding an innermost lower roll until an outermost lower roll abuts said outermost guide and a second portion for guiding the said innermost roll when said outermost roll reaches an end of said outermost guide.

2. The device according to claim 1 further comprising vertical guides mounted on both vertical portions of said path for guiding said outermost roll.

3. The device according to claim 2 wherein said vertical guides include an extension which extends above an upper horizontal part of the path for guiding an outer side of the outermost roll.

4. The device according to claim 2 wherein the vertical guides are connected along a lower horizontal portion of said path by means of an extension comprising an angle section.

5. The device according to claim 1 further comprising supporting rolls attached to the shaft, the supporting roll nearest said pick up member being bounded by two supporting roll guides and the supporting roll furthest from said pick up member being bounded by one supporting roll guide.

6. The device according to claim 5 further comprising:

a pair of sprocket wheels mounted on shafts at each of the upper and lower angular points of said frame, one of said shafts at a lower angular point being fixed and a second of said shafts at a lower angular point being repositionable; and a carrying member mounted on said shafts, said supporting roll guides, said innermost guide and a voltage rail being attached to said carrying member.

7. The device according to claim 1 wherein the pick up member is slidable in a longitudinal direction of the shaft.

8. The device according to claim 7 further comprising a guide for displacing said pick up member in a direction of the endless carrier and guides at lower ends of both vertical portions of the path for displacing the pick up member away from the endless carrier.

9. The device according to claim 8 further comprising a pick up cam mounted onto the pick up member, outer ends of said pick up cam having blocks of synthetic material mounted thereon which cooperate with the guide for displacing the pick up member along the lower horizontal portion of the path and wherein said pick up member includes rolls at a rear side thereof for cooperating with the guides at the lower ends of both vertical portions of the path.

* * * * *